US010102818B2

(12) United States Patent
Kuo et al.

(10) Patent No.: US 10,102,818 B2
(45) Date of Patent: Oct. 16, 2018

(54) LIQUID CRYSTAL DISPLAY

(71) Applicant: SHENZHEN CHINA STAR OPTOELECTRONICS TECHNOLOGY CO., LTD., Shenzhen, Guangdong (CN)

(72) Inventors: Pingsheng Kuo, Shenzhen (CN); Xianming Zhang, Shenzhen (CN); Liwei Chu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 339 days.

(21) Appl. No.: 14/908,250

(22) PCT Filed: Jan. 13, 2016

(86) PCT No.: PCT/CN2016/070813

§ 371 (c)(1),
(2) Date: Jan. 28, 2016

(87) PCT Pub. No.: WO2017/113441

PCT Pub. Date: Jul. 6, 2017

(65) Prior Publication Data

US 2017/0256222 A1 Sep. 7, 2017

(30) Foreign Application Priority Data

Dec. 31, 2015 (CN) ..... 2015 1 1027316

(51) Int. Cl.
*G09G 3/36* (2006.01)

(52) U.S. Cl.
CPC ... *G09G 3/3677* (2013.01); *G09G 2300/0809* (2013.01); *G09G 2310/0289* (2013.01); *G09G 2330/025* (2013.01); *G09G 2330/04* (2013.01)

(58) Field of Classification Search
CPC .. G09G 3/3614; G09G 3/3677; G09G 3/3688; G09G 3/2003; G09G 2300/0426;
(Continued)

(56) References Cited

U.S. PATENT DOCUMENTS

2009/0267704 A1 10/2009 Chang et al.
2011/0141098 A1 6/2011 Yaguma et al.
(Continued)

FOREIGN PATENT DOCUMENTS

CN 101562433 A 10/2009
CN 103021466 A 4/2013
(Continued)

*Primary Examiner* — Mark Edwards
(74) *Attorney, Agent, or Firm* — Sughrue Mion, PLLC

(57) ABSTRACT

An LCD includes a substrate, gate on array (GOA) units connected in series, a controller, a level shifter, and an over-current protection circuit. The substrate includes a pixel array section and a circuit arrangement section. The GOA units are used for outputting a scanning signal to the pixel array section based on voltage levels of clock signals and a voltage level of a start signal. The controller generates the clock signals and the start signal. The level shifter adjusts the voltage levels of the clock signals and the voltage level of the start signal. The over-current protection circuit outputs an adjusting signal to the controller to turn off the LCD when a magnitude of one of the plurality of clock signals is over a predetermined value. Therefore, the LCD is turned off for a while, preventing from being burnt out.

11 Claims, 2 Drawing Sheets

(58) Field of Classification Search
CPC ..... G09G 2310/0251; G09G 2310/08; G09G 2320/0261; G09G 2330/023
See application file for complete search history.

(56) References Cited

U.S. PATENT DOCUMENTS

| | | | | |
|---|---|---|---|---|
| 2013/0077736 | A1 | 3/2013 | Son | |
| 2014/0118324 | A1* | 5/2014 | Chan | G09G 3/3677 345/212 |
| 2014/0168049 | A1 | 6/2014 | Gu et al. | |
| 2015/0188431 | A1* | 7/2015 | Cho | G09G 3/2003 345/212 |
| 2016/0253950 | A1* | 9/2016 | Ma | G09G 3/36 345/100 |
| 2016/0372070 | A1 | 12/2016 | Hu et al. | |
| 2017/0263166 | A1 | 9/2017 | Chen | |

FOREIGN PATENT DOCUMENTS

| | | | | |
|---|---|---|---|---|
| CN | 104575436 | A | | 4/2015 |
| CN | 104700811 | A | * | 6/2015 |
| CN | 104753349 | A | | 7/2015 |
| CN | 105162077 | A | | 12/2015 |
| WO | 2010/114014 | A1 | | 10/2010 |

* cited by examiner

LIQUID CRYSTAL DISPLAY

BACKGROUND OF THE INVENTION

1. Field of the Invention

The present invention relates to a liquid crystal display (LCD), and more particularly, to an LCD adopting a gate driver on array (GOA) substrate.

2. Description of the Prior Art

Liquid crystal displays, on account of their high resolution requirement, are widely applied to various electronic devices, such as mobile phones, personal digital assistants, digital cameras, computer displays, and notebook computer displays.

A conventional LCD comprises a source driver, a gate driver, and an LCD panel. The gate driver is comprises a shift register, a logic circuit, a level shifter, and a digital buffer for the design of conventional LCD panels. The shift register is mainly used for outputting a scanning signal to the LCD panel at every fixed interval. As for an LCD panel with the resolution of 1024×768, the red (R), green (G), and blue (B) sub-pixels are arranged horizontally. Take the refresh rate of 60 Hz for example. The display time of each frame is about 1/60=16.67 ms. So the pulse of each scanning signal is about 16.67 ms/768=21.7 μs. The pixels are charged and discharged to a required voltage for showing corresponding grayscales on the time of 21.7 ρs with the source driver.

To produce an LCD with a narrow border, the gate drivers are fabricated on array (GOA). The LCD comprises a controller, a source driver, a GOA unit, and a panel. The panel comprises a pixel array section. When clock signals and controlling signals of gate drivers are transmitted to the GOA unit, the GOA unit will generate a scanning signal and transmit the scanning signal to pixels arranged in the pixel array section. Meanwhile, the source driver will output a grayscale voltage to the pixels arranged in the pixel array section.

The both sides of the panel are just where the sealant is coated. Vapors may seep down to the sealant due to ageing, poor quality, poor coating, or other cause, resulting in short circuits among controlling signals of the GOA circuits and further burning the panel out.

SUMMARY OF THE INVENTION

To solve the technical problem that the substrate may be burnt out in the conventional technology, an LCD comprising a substrate against burnout should be proposed.

According to the present invention, a liquid crystal display (LCD) comprises: a substrate, comprising a pixel array section and a circuit arrangement section arranged on a first side and a second side of the pixel array section; a plurality of gate on array (GOA) units connected in series, disposed on the circuit arrangement section, for outputting a scanning signal to the pixel array section based on voltage levels of a plurality of clock signals and a voltage level of a start signal; a controller, for generating the plurality of clock signals and the start signal; a level shifter, electrically connected to the controller, for adjusting the voltage levels of the plurality of clock signals and the voltage level of the start signal; and an over-current protection circuit, electrically connected to the level shifter, for outputting an adjusting signal to the controller to turn off the LCD when a magnitude of one of the plurality of clock signals is over a predetermined value. The plurality of clock signals comprise a first clock signal, a second clock signal, and a third clock signal, each of the plurality of GOA circuit units at each stage for outputting a scanning signal at an output terminal according to a scanning signal output by a GOA circuit unit at a previous stage, a scanning signal output by a GOA circuit unit at a next stage, a first constant voltage, a second constant voltage, the first clock signal, the second clock signal, and the third clock signal. Upon receiving the adjusting signal, the controller switches the clock signals and the start signal to a floating state, and then turns off the LCD.

In one aspect of the present invention, upon receiving the adjusting signal, the controller switches the clock signals and the start signal to the first constant voltage or the second constant voltage, and then turns off the LCD.

In another aspect of the present invention, each of the plurality of GOA circuit units at each stage comprises: an input control module, for outputting a controlling signal at a controlling node according to the first clock signal and the third clock signal; an output control module, electrically connected to the controlling node, for outputting the scanning signal at the output terminal according to the controlling signal and the second clock signal; and a pull-down module, electrically connected to the output control module, for pulling the scanning signal down to be at low level.

In another aspect of the present invention, the pull-down module comprises: a first transistor, comprising a gate electrically connected to the controlling node, a drain electrically connected to a pull-down driving node, and a source electrically connected to the first constant voltage; a second transistor, comprising a gate electrically connected to the pull-down driving node, a drain electrically connected to the output terminal, and a source electrically connected to the first constant voltage; a third transistor, comprising a gate electrically connected to the pull-down driving node, and a source electrically connected to the first constant voltage; and a resistor, comprising two terminals electrically connected to the second constant voltage and the pull-down driving node, respectively.

In another aspect of the present invention, the input control module comprises: a fourth transistor, comprising a gate electrically connected to the first clock signal, a drain electrically connected to the scanning signal output by the GOA circuit unit at the previous stage, and a source electrically connected to the controlling node; a fifth transistor, comprising a gate electrically connected to the third clock signal, a drain electrically connected to the controlling node, and a source electrically connected to the scanning signal output by the GOA circuit unit at the next stage.

In still another aspect of the present invention, the output control module comprises: a sixth transistor, comprising a gate electrically connected to the second constant voltage, a drain electrically connected to the controlling node, and a source electrically connected to a drain of the third transistor; a seventh transistor, comprising a gate electrically connected to the source of the sixth transistor, a drain electrically connected to the second clock signal, and a source electrically connected to the output terminal; and a capacitor, connected between the source and the gate of the seventh transistor, respectively.

In yet another aspect of the present invention, the over-current protection circuit is integrated in the level shifter.

According to the present invention, a liquid crystal display (LCD) comprises: a substrate, comprising a pixel array section and a circuit arrangement section arranged on a first side and a second side of the pixel array section; a plurality of gate on array (GOA) units connected in series, disposed on the circuit arrangement section, for outputting a scanning signal to the pixel array section based on voltage levels of a plurality of clock signals and a voltage level of a start signal;

a controller, for generating the plurality of clock signals and the start signal; a level shifter, electrically connected to the controller, for adjusting the voltage levels of the plurality of clock signals and the voltage level of the start signal; and an over-current protection circuit, electrically connected to the level shifter, for outputting an adjusting signal to the controller to turn off the LCD when a magnitude of one of the plurality of clock signals is over a predetermined value.

In one aspect of the present invention, the plurality of clock signals comprise a first clock signal, a second clock signal, and a third clock signal, each of the plurality of GOA circuit units at each stage for outputting a scanning signal at an output terminal according to a scanning signal output by a GOA circuit unit at a previous stage, a scanning signal output by a GOA circuit unit at a next stage, a first constant voltage, a second constant voltage, the first clock signal, the second clock signal, and the third clock signal.

In another aspect of the present invention, upon receiving the adjusting signal, the controller switches the clock signals and the start signal to the first constant voltage or the second constant voltage, and then turns off the LCD.

In another aspect of the present invention, upon receiving the adjusting signal, the controller switches the clock signals and the start signal to a floating state, and then turns off the LCD.

In another aspect of the present invention, each of the plurality of GOA circuit units at each stage comprises: an input control module, for outputting a controlling signal at a controlling node according to the first clock signal and the third clock signal; an output control module, electrically connected to the controlling node, for outputting the scanning signal at the output terminal according to the controlling signal and the second clock signal; and a pull-down module, electrically connected to the output control module, for pulling the scanning signal down to be at low level.

In another aspect of the present invention, the pull-down module comprises: a first transistor, comprising a gate electrically connected to the controlling node, a drain electrically connected to a pull-down driving node, and a source electrically connected to the first constant voltage; a second transistor, comprising a gate electrically connected to the pull-down driving node, a drain electrically connected to the output terminal, and a source electrically connected to the first constant voltage; a third transistor, comprising a gate electrically connected to the pull-down driving node, and a source electrically connected to the first constant voltage; and a resistor, comprising two terminals electrically connected to the second constant voltage and the pull-down driving node, respectively.

In another aspect of the present invention, the input control module comprises: a fourth transistor, comprising a gate electrically connected to the first clock signal, a drain electrically connected to the scanning signal output by the GOA circuit unit at the previous stage, and a source electrically connected to the controlling node; a fifth transistor, comprising a gate electrically connected to the third clock signal, a drain electrically connected to the controlling node, and a source electrically connected to the scanning signal output by the GOA circuit unit at the next stage.

In still another aspect of the present invention, the output control module comprises: a sixth transistor, comprising a gate electrically connected to the second constant voltage, a drain electrically connected to the controlling node, and a source electrically connected to a drain of the third transistor; a seventh transistor, comprising a gate electrically connected to the source of the sixth transistor, a drain electrically connected to the second clock signal, and a source electrically connected to the output terminal; and a capacitor, connected between the source and the gate of the seventh transistor, respectively.

In yet another aspect of the present invention, the over-current protection circuit is integrated in the level shifter.

Compared with the conventional LCD, the LCD proposed by the present invention further comprises an over-current protection circuit. The over-current protection circuit is used for outputting an adjusting signal to the controller to turn off the LCD when a magnitude of one of the clocks exceeds a predetermined value. So the LCD is turned off for a while, and a black image shows. In this way, it is impossible to burn the substrate out.

These and other objectives of the present invention will become apparent to those of ordinary skill in the art after reading the following detailed description of the preferred embodiment that is illustrated in the various figures and drawings.

DETAILED DESCRIPTION OF THE PREFERRED EMBODIMENTS

Figure 1:
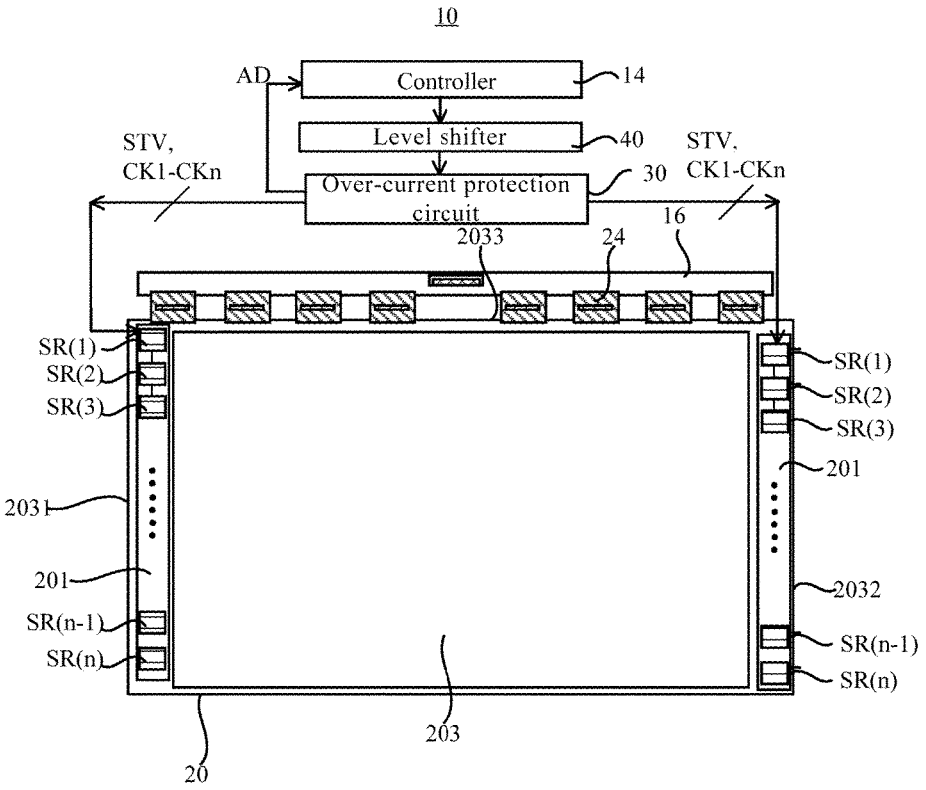
FIG. 1 is a schematic diagram of an LCD 10 adopting a substrate according to the present invention.

Please refer to FIG. 1. FIG. 1 is a schematic diagram of an LCD 10 according to the present invention. The LCD 10 comprises a controller 14, a source driver 16, a plurality of gate on array (GOA) units SR(1)~SR(n), an over-current protection circuit 30, a level shifter 40, and a substrate 20. The substrate 20 comprises a first side 2031, a second side 2032, and a third side 2033. The first side 2031 and the second side 2032 are in parallel. The third side 2033 is perpendicular to the first side 2031 and the second side 2032. The substrate 20 comprises a pixel array section 203 and a circuit arrangement section 201 arranged on both sides of the pixel array section 203. The plurality of GOA units SR(1)~SR(n) are arranged on the circuit arrangement section 201. The source driver 16 is arranged on the third side 2033 of the substrate 20. The source driver 16 is electrically connected to pixels arranged on the pixel array section 203 through a flexible printed circuit (FPC) 24. The plurality of GOA units SR(1)~SR(n) will generate a scanning signal and transmit the scanning signal to the pixel of the pixel array section 203 when clock signals CK1-CK4 generated by the controller 14 and a start signal generated by the controller 14 are transmitted to the plurality of GOA units SR(1)~SR(n). The source driver 16 will output a grayscale voltage to the pixels arranged on the pixel array section 203 at the same time.

The plurality of GOA units SR(1)~SR(n) shown in FIG. 1 are connected in a sequence. The plurality of GOA units SR(1)~SR(n) are connected to the plurality of rows of pixels in the pixel array section 203 one-on-one. For example, an LCD panel with the resolution of 1024×768 comprises 768 GOA units SR(n). The R, G, B sub-pixels are arranged horizontally. Each of the plurality of GOA units SR(1)~SR(n) is connected to a row of pixels where n is 768. The GOA unit SR(n) outputs the scanning signal from the output terminal G(n) to the pixels at the nth row of the pixel array section 203, according the voltage levels of the clock signal CK(n) and the start signal STV(n). The level shifter 40 electrically connected to the controller 14 is used for adjusting the voltage levels of the clock signals CK1-CKn and the start signal STV(n). The over-current protection circuit 30 electrically connected to the level shifter 40 is used for outputting the adjusting signal AD to the controller 14 to turn off the LCD 10, when the magnitude of one of the clock signals CK1-CKn is over a predetermined value.

Figure 2:
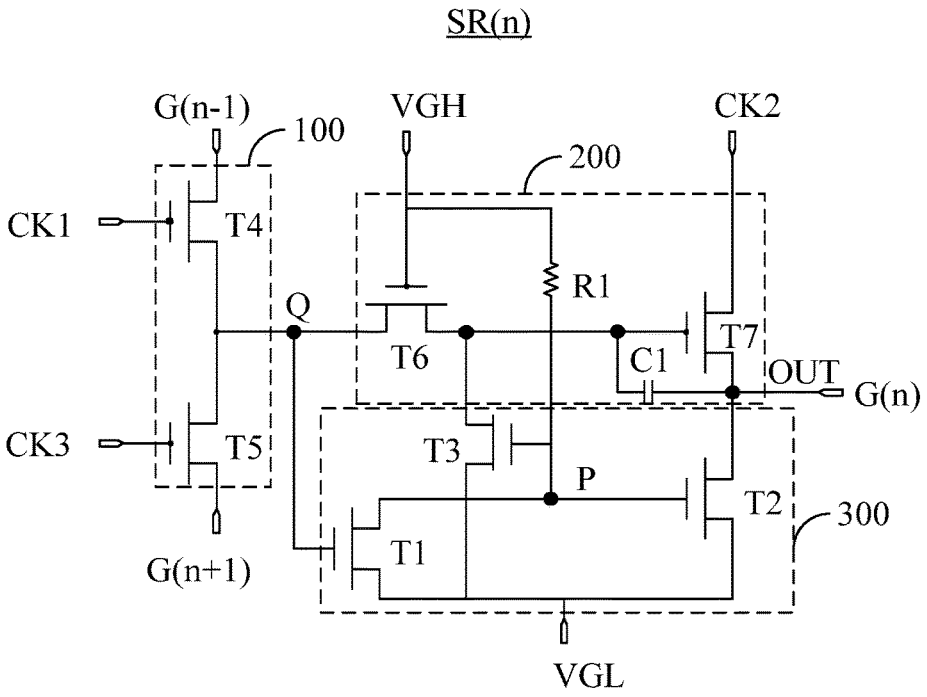
FIG. 2 is a circuit diagram of a GOA circuit unit.

Please refer to FIG. 2. FIG. 2 is a circuit diagram of the GOA unit SR(n). The circuit of each of the plurality of GOA units SR(n) is identical. Only the circuit of the GOA unit SR(n) is described herein. The GOA unit SR(n) in the present disclosure is driven by three clock signals CK1-CK3, but other GOA unit SR(n) driven by three or more clock signals also belongs to the scope of the present invention. The GOA circuit unit SR(n) at each stage is used for outputting a scanning signal G(n) at an output terminal OUT according to a scanning signal G(n−1) output by a GOA circuit unit SR(n−1) at a previous stage, a scanning signal G(n+1) output by a GOA circuit unit SR(n+1) at a next stage, a first clock signal CK1, a second clock signal CK2, and a third clock signal CK3. The GOA circuit unit SR(n) at each stage comprises an input control module 100, an output control module 200, and a pull-down module 300. The input control module 100 is used for outputting a controlling signal Q(n) at a controlling node Q according to the first clock signal CK1 and the third clock signal CK3. The output control module 200 is electrically connected to the controlling node Q and used for outputting a scanning signal G(n) at the output terminal OUT according to the controlling signal Q(n) and the second clock signal CK2. The pull-down module 300 is electrically connected to the output control module 200 and used for pulling the scanning signal G(n) down to be at low voltage level.

The pull-down 300 comprises a first transistor T1, a second transistor T2 a third transistor T3, and a resistor R1. A gate of the first transistor T1 is electrically connected to the controlling node Q. A drain of the first transistor T1 is electrically connected to a pull-down driving node P. A source of the first transistor T1 is electrically connected to a first constant voltage VGL. A gate of the second transistor T2 is electrically connected to the pull-down driving node P. A drain of the second transistor T2 is electrically connected to the output terminal OUT. A source of the second transistor T2 is electrically connected to the first constant voltage VGL. A gate of the third transistor T3 is electrically connected to the pull-down driving node P. A source of the third transistor T3 is electrically connected to the first constant voltage VGL. Two terminals of the resistor R1 are electrically connected to a second constant voltage VGH and the pull-down driving node P, respectively.

The input control module 100 comprises a fourth transistor T4 and a fifth transistor T5. A gate of the fourth transistor T4 is electrically connected to the first clock signal CK1. A drain of the fourth transistor T4 is electrically connected to the scanning signal G(n−1) output by the GOA circuit unit SR(n−1) at the previous stage. A source of the fourth transistor T4 is electrically connected to the controlling node Q. A gate of the fifth transistor T5 is electrically connected to the third clock signal CK3. A drain of the fifth transistor T5 is electrically connected to the controlling node Q. A source of the fifth transistor T5 is electrically connected to the scanning signal G(n+1) output by the GOA circuit unit SR(n+1) at the next stage.

The output control module 200 comprises a sixth transistor T6, a seventh transistor T7, and a capacitor C1. A gate of the sixth transistor T6 is electrically connected to the second constant voltage VGH. A drain of the sixth transistor T6 is electrically connected to the controlling node Q. A source of the sixth transistor T6 is electrically connected to a drain of the third transistor T3. A gate of the seventh transistor T7 is electrically connected to a source of the sixth transistor T6. A drain of the seventh transistor T7 is electrically connected to the second clock signal CK2. A source of the seventh transistor T7 is electrically connected to the output terminal OUT. Two terminals of the capacitor C1 are connected to the source and gate of the seventh transistor T7, respectively.

The GOA unit SR(n) of the present invention is not limited to the circuit shown in FIG. 2. Other GOA unit SR(n) driven by multiple clock signals CK1-CKn also belongs to the scope of the present invention.

Figure 3:
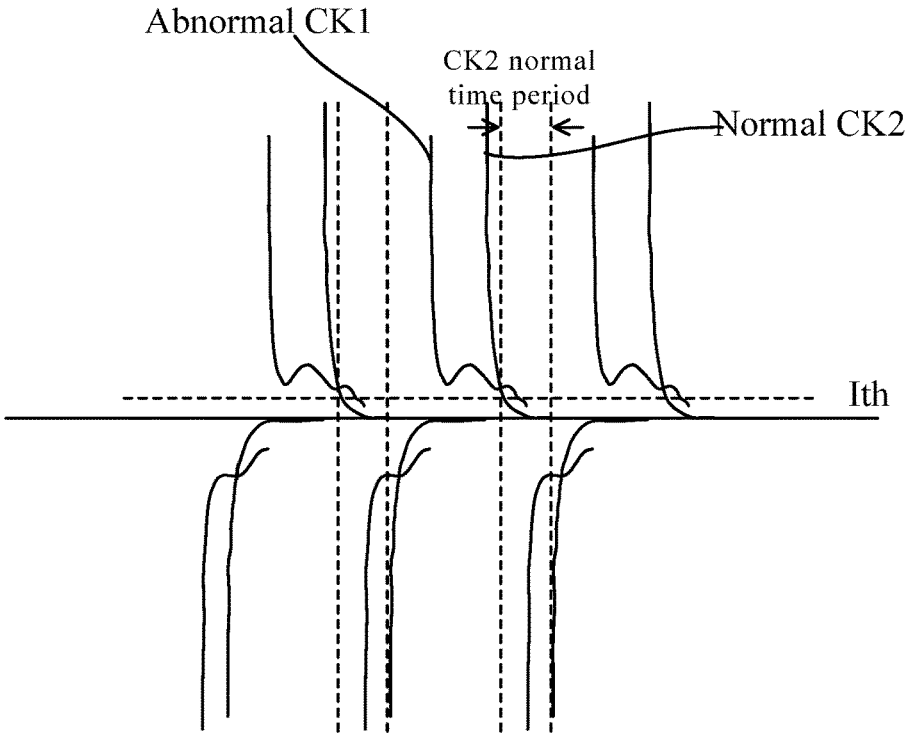
FIG. 3 shows that the over-current protection circuit determines whether the clock signals CK1 and CK2 is normal.

Please refer to FIG. 3. FIG. 3 shows a diagram of the over-current protection circuit determining whether the clock signals CK1 and CK2 are normal in the normal time period. The over-current protection circuit 30 is electrically connected to the level shifter 40. Specifically, FIG. 3 shows an output current corresponding to the clock signal CK1 in the normal time period. When the clock signal CK1 is short-circuited to cause an abnormal output current, the abnormal output current of the clock signal CK1 is about 10~40 mA during the normal time period. By contrast, the normal output current of the clock signal CK2 nearly equals to 0 mA during the normal time period. Accordingly, the over-current protection circuit 30 sets a predetermined value Ith as 30 mA. In response to current of any one of the clock signals CK1-CKn in excess of the predetermined value Ith in the normal time period, the over-current protection circuit 30 outputs the adjusting signal AD to the controller 14. Upon receiving the adjusting signal AD, the controller 14 switches the clock signals CK1-CKn and the start signal STV to the first constant voltage VGH or the second constant voltage VGL, and then turn off the LCD 10. In another embodiment, upon receiving the adjusting signal AD, the controller 14 switches the clock signals CK1-CKn and the start signal STV to a floating state, and then turn off the LCD 10.

Although the predetermined value Ith is 30 mA in the embodiment, one skilled in the art is aware that the predetermined value Ith may be adjusted to other values, such as 10 mA, 20 mA, or 40 mA, depending on the practical applications. Additionally, the over-current protection circuit 30 can be integrated in the level shifter 40.

To sum up, the LCD proposed by the present invention further comprises an over-current protection circuit. The over-current protection circuit is used for outputting an adjusting signal to the controller to turn off the LCD when a magnitude of one of the clocks exceeds a predetermined value. So the LCD is turned off for a while, and a black image shows. In this way, it is impossible to burn the substrate out.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A liquid crystal display (LCD), comprising:

a substrate, comprising a pixel array section and a circuit arrangement section arranged on a first side and a second side of the pixel array section;

a plurality of gate on array (GOA) units connected in series, disposed on the circuit arrangement section, for outputting a scanning signal to the pixel array section based on voltage levels of a plurality of clock signals and a voltage level of a start signal;

a controller, for generating the plurality of clock signals and the start signal;

a level shifter, electrically connected to the controller, for adjusting the voltage levels of the plurality of clock signals and the voltage level of the start signal; and an over-current protection circuit, electrically connected to the level shifter, for outputting an adjusting signal to the controller to turn off the LCD when a magnitude of one of the plurality of clock signals is over a predetermined value;

wherein the plurality of clock signals comprise a first clock signal, a second clock signal, and a third clock signal, each of the plurality of GOA circuit units at each stage for outputting a scanning signal at an output terminal according to a scanning signal output by a GOA circuit unit at a previous stage, a scanning signal output by a GOA circuit unit at a next stage, a first constant voltage, a second constant voltage, the first clock signal, the second clock signal, and the third clock signal, wherein upon receiving the adjusting signal, the controller switches the clock signals and the start signal to a floating state, and then turns off the LCD, wherein each of the plurality of GOA circuit units at each stage comprises:

an input control module, for outputting a controlling signal at a controlling node according to the first clock signal and the third clock signal;

an output control module, electrically connected to the controlling node, for outputting the scanning signal at the output terminal according to the controlling signal and the second clock signal; and a pull-down module, electrically connected to the output control module, for pulling the scanning signal down to be at low level, wherein the pull-down module comprises:

a first transistor, comprising a gate electrically connected to the controlling node, a drain electrically connected to a pull-down driving node, and a source electrically connected to the first constant voltage;

a second transistor, comprising a gate electrically connected to the pull-down driving node, a drain electrically connected to the output terminal, and a source electrically connected to the first constant voltage;

a third transistor, comprising a gate electrically connected to the pull-down driving node, and a source electrically connected to the first constant voltage; and a resistor, comprising two terminals electrically connected to the second constant voltage and the pull-down driving node, respectively.

2. The LCD as claimed in claim 1, wherein upon receiving the adjusting signal, the controller switches the clock signals and the start signal to the first constant voltage or the second constant voltage, and then turns off the LCD.

3. The LCD as claimed in claim 1, wherein the input control module comprises:

a fourth transistor, comprising a gate electrically connected to the first clock signal, a drain electrically connected to the scanning signal output by the GOA circuit unit at the previous stage, and a source electrically connected to the controlling node;

a fifth transistor, comprising a gate electrically connected to the third clock signal, a drain electrically connected to the controlling node, and a source electrically connected to the scanning signal output by the GOA circuit unit at the next stage.

4. The LCD as claimed in claim 3, wherein the output control module comprises:

a sixth transistor, comprising a gate electrically connected to the second constant voltage, a drain electrically connected to the controlling node, and a source electrically connected to a drain of the third transistor;

a seventh transistor, comprising a gate electrically connected to the source of the sixth transistor, a drain electrically connected to the second clock signal, and a source electrically connected to the output terminal; and a capacitor, connected between the source and the gate of the seventh transistor, respectively.

5. The LCD as claimed in claim 1, wherein the over-current protection circuit is integrated in the level shifter.

6. A liquid crystal display (LCD), comprising:

a substrate, comprising a pixel array section and a circuit arrangement section arranged on a first side and a second side of the pixel array section;

a plurality of gate on array (GOA) units connected in series, disposed on the circuit arrangement section, for outputting a scanning signal to the pixel array section based on voltage levels of a plurality of clock signals and a voltage level of a start signal;

a controller, for generating the plurality of clock signals and the start signal;

a level shifter, electrically connected to the controller, for adjusting the voltage levels of the plurality of clock signals and the voltage level of the start signal; and an over-current protection circuit, electrically connected to the level shifter, for outputting an adjusting signal to the controller to turn off the LCD when a magnitude of one of the plurality of clock signals is over a predetermined value, wherein the plurality of clock signals comprise a first clock signal, a second clock signal, and a third clock signal, each of the plurality of GOA circuit units at each stage for outputting a scanning signal at an output terminal according to a scanning signal output by a GOA circuit unit at a previous stage, a scanning signal output by a GOA circuit unit at a next stage, a first constant voltage, a second constant voltage, the first clock signal, the second clock signal, and the third clock signal, wherein each of the plurality of GOA circuit units at each stage comprises:

an input control module, for outputting a controlling signal at a controlling node according to the first clock signal and the third clock signal;

an output control module, electrically connected to the controlling node, for outputting the scanning signal at the output terminal according to the controlling signal and the second clock signal; and a pull-down module, electrically connected to the output control module, for pulling the scanning signal down to be at low level, wherein the pull-down module comprises:

a first transistor, comprising a gate electrically connected to the controlling node, a drain electrically connected to a pull-down driving node, and a source electrically connected to the first constant voltage;

a second transistor, comprising a gate electrically connected to the pull-down driving node, a drain electrically connected to the output terminal, and a source electrically connected to the first constant voltage;

a third transistor, comprising a gate electrically connected to the pull-down driving node, and a source electrically connected to the first constant voltage; and a resistor, comprising two terminals electrically connected to the second constant voltage and the pull-down driving node, respectively.

7. The LCD as claimed in claim 6, wherein upon receiving the adjusting signal, the controller switches the clock signals and the start signal to the first constant voltage or the second constant voltage, and then turns off the LCD.

8. The LCD as claimed in claim 6, wherein upon receiving the adjusting signal, the controller switches the clock signals and the start signal to a floating state, and then turns off the LCD.

9. The LCD as claimed in claim 6, wherein the input control module comprises:

a fourth transistor, comprising a gate electrically connected to the first clock signal, a drain electrically connected to the scanning signal output by the GOA circuit unit at the previous stage, and a source electrically connected to the controlling node;

a fifth transistor, comprising a gate electrically connected to the third clock signal, a drain electrically connected to the controlling node, and a source electrically connected to the scanning signal output by the GOA circuit unit at the next stage.

10. The LCD as claimed in claim 6, wherein the output control module comprises:

a sixth transistor, comprising a gate electrically connected to the second constant voltage, a drain electrically connected to the controlling node, and a source electrically connected to a drain of the third transistor;

a seventh transistor, comprising a gate electrically connected to the source of the sixth transistor, a drain electrically connected to the second clock signal, and a source electrically connected to the output terminal; and a capacitor, connected between the source and the gate of the seventh transistor, respectively.

11. The LCD as claimed in claim 6, wherein the overcurrent protection circuit is integrated in the level shifter.

* * * * *